United States Patent [19]

Schaller et al.

[11] 3,942,278

[45] Mar. 9, 1976

[54] FIRING PIN SAFETY DEVICE FOR HAND FIREARMS

[75] Inventors: Bernhard Schaller; Willi Volkmar, both of Ulm (Danube), Germany

[73] Assignee: Carl Walther Sportwaffenfabrik, Ulm (Danube), Germany

[22] Filed: Dec. 9, 1974

[21] Appl. No.: 531,152

[30] Foreign Application Priority Data

Dec. 15, 1973 Germany ..... 2362464

[52] U.S. Cl. ..... 42/70 F

[51] Int. Cl.[2] ..... F41C 17/04

[58] Field of Search ..... 42/70 F

[56] References Cited

UNITED STATES PATENTS

| | | | |
|---|---|---|---|
| 624,321 | 5/1899 | Fyrberg | 42/70 F |
| 3,633,303 | 1/1972 | Volkmar et al. | 42/70 F |
| 3,724,113 | 4/1973 | Ludwig | 42/70 F |
| 3,830,002 | 8/1974 | Volkmar | 42/70 F |

FOREIGN PATENTS OR APPLICATIONS

| | | | |
|---|---|---|---|
| 160,375 | 5/1941 | Austria | 42/70 F |
| 453,020 | 9/1936 | United Kingdom | 42/70 F |
| 692,741 | 6/1940 | Germany | 42/70 F |

*Primary Examiner*—Charles T. Jordan
*Attorney, Agent, or Firm*—Edmund M. Jaskiewicz

[57] ABSTRACT

A hand firearm having a firing pin which is pivotable between lower and upper positions has a slide with a notch in a side thereof within which is received the firing pin. A hammer is engageable with the firing pin when in the upper position and means including a trigger are provided for pivoting the hammer into its cocked position. A release lever is pivoted with the hammer and is engageable with the lower end of the slide to move the slide upwardly and thereby to also move the firing pin into its upper position in which position it is engageable by the hammer. The upward movement of the slide is against the force of the spring which urges the slide and firing pin downwardly into the lower position after firing of the firearm.

8 Claims, 4 Drawing Figures

A
A
18
12
19
16
8
21
5
4
2
7
17
6
3
11'
11
5'
10
9'
9''
9
1

B
1
18
12
17
16
8
21
2
19
7
6
13
3
4
5

2
14
12
20
15
13
11

5
21
4

FIRING PIN SAFETY DEVICE FOR HAND FIREARMS

The present invention relates to a firing pin safety device for hand firearms such as automatic pistols having a firing pin that can be temporarily pivoted from the effective range of the hammer, more particularly, to the structure for pivoting of the firing pin.

Hand firearms have been provided wherein the firing pin is pivoted between positions so that in one position the hammer is temporarily displaced from the effective range of the hammer. German Pat. No. 670 241 discloses that when the firearm is in the safety position the rear end of the firing pin is pivoted about its front end from the range of the hammer by means of a safety pivot mounted on the safety lever. This arrangement is not particularly satisfactory since it is dependent on the operation of the safety device. Further, this arrangement cannot be used on pistols wherein for repeated or rapid fire the uncocked hammer is cocked during the pulling of the trigger without the necessity of first releasing the safety device since the loaded weapon is generally carried uncocked and with the safety device in the locked position.

A pistol has been proposed wherein the firing pin can be pivoted both when the safety device is applied or locked and also when the safety device is released. However, this pistol has the disadvantage that its structure requires the actuator for the pivoting movement to be arranged within the firing device and, accordingly, only a relatively limited range of pivoting is available. Further, the safety device pivot structure is unduly weakened by removing material from its cross-section that under actual conditions of usage for the pistol there is a considerable risk of malfunction or breaking of the safety device even after a relatively brief use of the weapon.

It is therefore the principal object of the present invention to provide a novel and improved firing pin safety device for firearms having a firing pin that can be pivoted temporarily from the effective range of the hammer.

It is another object of the present invention to provide such a firing pin safety device which is simple in construction, reliable in operation and prevents accidental firing of the weapon when the hammer of the loaded weapon is hit or bumped in any manner.

It is another object of the present invention to provide such a firing pin safety device wherein the pvioting of the firing pin is achieved independently of the safety lever.

According to one aspect of the present invention in a firing pin safety device for hand firearms there may be provided a firing pin which is pivotable between lower and upper positions. A moveable member which may be in for form of a slide is operatively connected to the firing pin. A pivotally mounted hammer is engageable with the firing pin in its upper position and means including a trigger is provided for pivoting the hammer into its cocked position. A release lever is pivotable with the hammer and during pivoting is engageable with the moveable member to move said member and thereby the firing pin into its upper position.

Other objects and advantages of the present invention will be apparent upon reference to the accompanying description when taken in conjunction with the following drawings, which are exemplary, wherein.

Proceeding next to the drawings wherein like reference symbols indicate the same parts throughout the various views a specific embodiment of the present invention will be described in detail.

Figure 1:
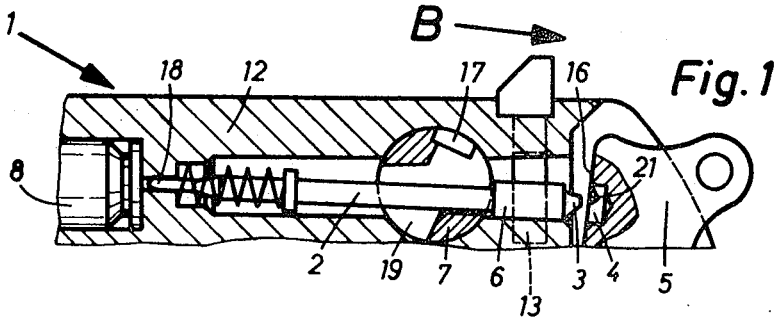
FIG. 1 is a longitudinal sectional view through a portion of the firearm incorporating the present invention showing the safety in its locked position and the hammer uncocked.

In FIG. 1, there is illustrated a portion of a firearm 1, which may be an automatic pistol, incorporating the present invention wherein the firearm is loaded, locked in the safety position and uncocked. A firing pin 2 is positioned for pivotal movement about its front end 18 and is shown in its lower position with its rear end 3 in front of a circular recess 4 formed in the striking face of a pivotally mounted hammer 5. Thus, should the hammer 5 be hit or bumped accidently or inadvertently the hammer will not contact the firing pin 2 since the rear end 3 of the firing pin projects into the recess 4 and any impact or movement of the hammer will not be transmitted to the firing pin.

In the uncocked position, the firing pin 2 is locked in such a manner that a collar or enlarged diameter portion 6 on the firing pin 2 is positioned against the outer periphery of a pivotally mounted safety shaft 7 which extends through the breech housing 12 transversely to the firing pin. The outer periphery of the safety shaft 7 bearing against firing pin collar 6 thus prevents moving of the firing pin in the direction toward a cartridge 8 which is loaded in the chamber of the firearm. The tip of the firing pin 18 thus cannot reach the percussion cap of the cartridge for discharging a shot. Nevertheless, the firearm is ready for firing as will next be explained in detail. A suitable safety lever as known in the art, is attached to the safety shaft 7 to pivot the safety shaft between its locked and unlocked position.

Figure 3:
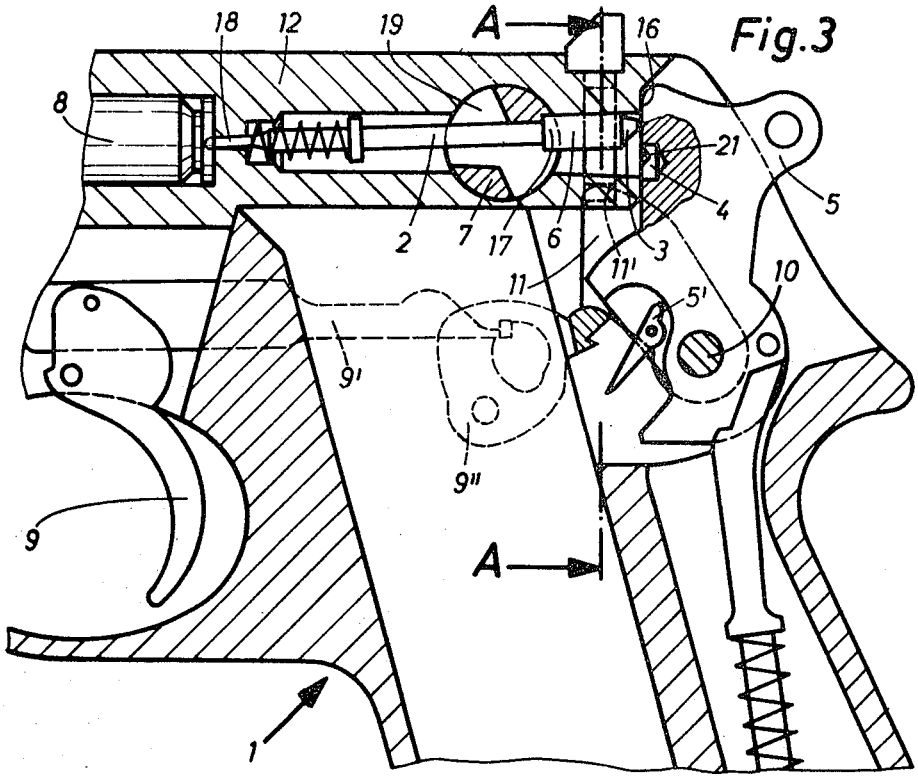
FIG. 3 is a longitudinal sectional view through a portion of the weapon of FIG. 1 at the instant when the cartridge is fired.

In the firing of the firearm, as a pivotally mounted trigger 9 is pulled, a trigger arm 9' which is pivotally connected to the trigger moves toward the left as viewed in FIG. 3 and pivots a cocking lever 9'' in the counter-clockwise direction. At the same time, a portion of the cocking lever 9'' engages the hammer 5 which is pivotally mounted on a pin 10 to cam the lever in a clockwise direction. A release lever 11 which is also mounted on the hammer pivot pin 10 is pivoted together with the hammer. The release lever 11 is provided with a nose surface 11' which cams against the lower end of a slide 13 which is mounted for sliding displacement in the breech housing 12 behind the safety shaft 7. The slide 13 is shown in its upper position in FIG. 2 and is urged downwardly into its lower position by a compression spring 14.

Figure 2:
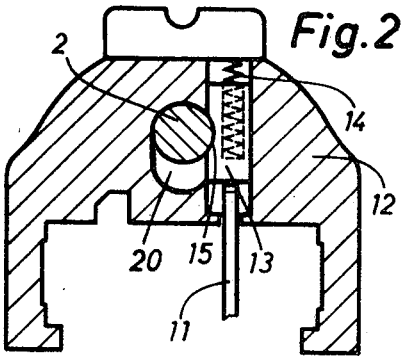
FIG. 2 is a sectional view taken along the line A—A of FIG. 3.

It has been known to employ a slide, such as slide 13, in similar firearms as a firing pin lock. According to the present invention, there is an arcuate-shaped recess or notch 15 in an edge of the slide 13 as seen in FIG. 2. Collar portion 6 of the firing pin is received within the notch 15 so that during upward sliding movement of slide 13 through a relatively large distance the rear end 3 of the firing pin 2 will be shifted upwardly into its upper or effective position wherein the rear end 3 of the firing pin is engageable by abutment surface 16 on the hammer 5. The slide 13 will be moved upwardly under the operation of the trigger 9 simultaneously with the cocking of the hammer 5 under the action of the pawl 5' as known in the art.

When the hammer 5 reaches its extreme rearward position, the hammer will be subjected to the action of a compressed spring acting upon a biasing rod to cause the hammer to move forwardly or to the left as viewed in FIG. 3 so that the abutment surface 16 of the hammer strikes rear end 3 of the firing pin to fire the cartridge 8. The movement to the left of the firing pin 3 is possible since the collar 6 of the firing pin will enter a recess 17 of the safety shaft which has been moved to its unlocked or release position.

After firing, the firearm is again locked and cocked automatically in a known manner and can be locked in the safety position by pivoting the safety shaft 7 into the position as shown in FIG. 1. When the shaft 7 is pivoted into the locked position the cocked hammer 5 is uncocked in a known manner. After trigger 9 has been released and during its backward or return travel before the shot is fired as well as during the uncocking of the hammer 5, the slide 13 together with the firing pin 2 is again moved downwardly into its initial or lower position under the action of compression spring 14 so that the weapon is again locked against an unintentional firing.

The safety shaft 7 is provided with an opening therethrough 19 through which the firing pin 2 extends in order to provide for pivoting movement of the firing pin. The opening 19 thus limits the range of pivoting of the firing pin between the safety or locked position and the firing position.

As seen in FIG. 2, an elongated opening or slot 20 is arranged vertically in the breech housing 12 for guiding the firing pin 2 for movement in a vertical plane during its pivotal movement.

Figure 4:
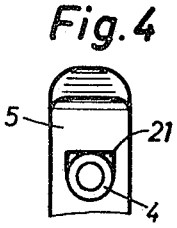
FIG. 4 is an elevational view of a portion of the hammer viewed in the direction of the arrow B of FIG. 1.

As may be seen in FIG. 4, the circular recess 4 in the forward surface of the hammer 5 is provided with a groove or slot 21 to provide additional clearance. The upper edge of the slot 21 is tangential to the upper surface of the circular recess 4 as may be seem in FIG. 4 so that any contact of the rear end 3 of the firing pin with the hammer 5 is avoided during the cocking operation.

Thus it can be seen that the present invention has disclosed a firearm having a pivotally disposed firing pin which is pivoted between its ineffective and effective or firing positions by a relatively simple structure.

Further, this pivoting of the firing pin to the firing position is accomplished simultaneously with the cocking of the hammer under the action of the trigger being pulled.

It will be understood that this invention is susceptible to modification in order to adapt it to different usages and conditions, and accordingly, it is desired to comprehend such modifications within this invention as may fall within the scope of appended claims.

What is claimed is:

1. In a firing pin safety device for hand firearms, a firing pin pivotable between lower and upper positions, a moveable member connected to said firing pin, a pivotally mounted hammer engageable with said firing pin in the upper position, means including a trigger for pivoting said hammer into the cocked position, and a release lever pivotable with said hammer and engageable with said moveable member to move said member and thereby the firing pin into its upper position.

2. In a firing pin safety device as claimed in claim 1 wherein said moveable member comprises a slide moveable transversely to said firing pin.

3. In a firing pin safety device as claimed in claim 2 wherein said slide has a notch in an edge thereof and said firing pin is received within said notch so as to be moveable thereby.

4. In a firing pin safety device as claimed in claim 2 and a compression spring acting against said slide to urge the slide and the firing pin into the lower position.

5. In a firing pin safety device as claimed in claim 1 wherein there is a recess in the hammer in the area of the lower portion of the firing pin so that the end of the firing pin projects into said recess when the hammer is in the uncocked position.

6. In a firing pin safety device as claimed in claim 5 wherein said recess is circular and there is a groove in the upper portion of said recess and having its upper edge tangent to the circular recess.

7. In a firing pin safety device as claimed in claim 1 and a pivotally mounted safety shaft having lock and release positions extending transversely to said firing pin and having an opening through which said firing pin extends, said opening being of such shape to enable said firing pin to pivot between its lower and upper positions.

8. In a firing pin safety device as claimed in claim 1 and a breech housing having an elongated opening therein within which said firing pin is guided between its lower and upper positions.

* * * * *